United States Patent [19]

Mason

[11] Patent Number: 4,668,156

[45] Date of Patent: May 26, 1987

[54] EXCAVATOR BUCKET

[76] Inventor: Samuel T. Mason, Emerson Close, Swainby, Northallerton, North Yorkshire DL6 3EL, England

[21] Appl. No.: 705,727

[22] Filed: Feb. 26, 1985

[30] Foreign Application Priority Data

Feb. 27, 1984 [GB] United Kingdom ..... 8405053
Apr. 24, 1984 [GB] United Kingdom ..... 8410438

[51] Int. Cl.[4] ..... E02F 3/413; B66C 3/00

[52] U.S. Cl. ..... 414/704; 414/705; 414/735; 414/740

[58] Field of Search ..... 414/697, 704, 735, 740, 414/705, 739

[56] References Cited

U.S. PATENT DOCUMENTS 3,273,729 9/1966 Holopainen ..... 414/739 X
3,595,416 7/1971 Perrotti ..... 414/704 X
4,017,114 4/1977 La Bounty ..... 414/740 X
4,030,626 6/1977 Durham ..... 414/704

FOREIGN PATENT DOCUMENTS 807950 1/1959 United Kingdom ..... 414/705
902611 8/1962 United Kingdom ..... 414/704

*Primary Examiner*—L. J. Paperner
*Assistant Examiner*—Jay I. Alexander
*Attorney, Agent, or Firm*—Cushman, Darby & Cushman

[57] ABSTRACT

An excavator bucket of improved versatility is characterized by having gripper means to enable the bucket to grip an object to be lifted and also by being mounted so that it is capable of pivotal movement about two independent axes which are substantially at right angles to each other.

3 Claims, 7 Drawing Figures

EXCAVATOR BUCKET

The present invention is an improved bucket for an excavator or similar piece of mobile construction plant (hereinafter referred to generally as an "excavator bucket"). The improved bucket is able to perform tasks not hitherto possible using excavator buckets currently available.

The main functions of excavator buckets are to dig holes and/or to lift excavated earth, debris or individual items such as rocks. These functions rely essentially upon the bucket as an open container and the range of objects which the excavator bucket can lift is therefore limited in size and shape. Various gripping devices have been proposed by means of which the bucket may be enabled to lift objects which do not fit securely into the bucket interior. Thus, by means of such devices, an excavator bucket may lift elongated objects such as telegraph poles and lumber. However, devices of this type have proved to be of limited value in lifting such elongated objects in that either the devices themselves have little or no freedom to maneouvre or they are so designed that their freedom is restricted by the object itself when it has been gripped.

It is therefore an aim of the present invention to provide an improved excavator bucket having a capacity for performing a wider range of tasks than hitherto available. A further aim is to provide an excavator bucket which is of particular value when installing telegraph poles and the like.

The excavator bucket according to the present invention is characterised by the combination of two features. Firstly, gripper means are provided to enable the bucket to grip an object to be lifted. Secondly, the bucket is mounted for pivotal movement about two independent axes substantially at right angles to each other.

The gripper means may be independent of the leading edge (that is, the earth-engaging edge) of the bucket or that edge of the bucket or the sides of the bucket front may be a feature of the gripping means. Thus, for example, excavator buckets have been proposed which divide into a front section and a rear section, so that objects may be gripped between said two sections. An alternative, preferred arrangement for the present invention is one in which a gripping member co-operates with the earth-engaging edge of the bucket or, less preferably, the sides of the bucket front so as to grip an object therebetween. In a particularly preferred arrangement a gripping member is mounted for movement between a rearward, non-gripping position in which said gripping member is located at least substantially within the bucket and a forward, gripping position in which an object may be gripped between the gripping member and the earth-engaging part of the bucket.

When an elongated object is gripped in position in an excavator bucket, it will normally lie across the bucket, that is generally parallel to the leading edge thereof. Excavator buckets conventionally are mounted for restricted pivotal movement about an axis which also lies parallel to that leading edge, to enable the inclination of the bucket to be varied as desired, for example between excavating and lifting positions. Such conventional pivoting is about a generally horizontal axis which in the case of the present invention will be referred to as the first axis of pivotal movement.

The excavator bucket of the present invention has a second axis of pivotal movement substantially at right angles to said first axis of pivotal movement. By means of this second axis, when an object, especially an elongated object, has been gripped by the excavator bucket, the orientation of that object in a vertical plane may be changed by pivoting the bucket about the second axis. More specifically, a telegraph pole or the like may be gripped and then lifted horizontally from a position in which it is lying on the ground and thereafter swung through ninety degrees into a vertical position ready for installation. By the reverse procedure, a previously erected pole may be lifted out of its vertical position and laid on the ground.

Similar operations may be entailed when planting grown or partly-grown trees or when moving lumber for stacking or other purposes.

The pivotal movement about said second axis may be through a half circle or more if desired but fully adequate results are obtained by limiting the pivotal movement to ninety degrees of arc or a little more, say one hundred or one hundred and ten degrees. Such movement clearly permits objects to be swung from horizontal to vertical positions and may afford some leeway if the object is not lying level or the excavator itself is on a sloping or irregular surface.

The pivoting of the excavator bucket about its second axis may be effected by the provision of any form of rotary drive but it is much preferred that it be effected by the action of a linear hydraulic or pneumatic drive means, for example a double-acting hydraulic piston, operating between a position on the bucket and a fixed position on the bucket support. If it is desired to permit pivoting about an angle greater than is practicable with a direct linear drive, then a rack-and-pinion drive may be adopted.

An important further advantage of the excavator bucket according to the present invention is that it may be designed so as to function as a conventional excavator bucket when its special features are not in use. Thus provision may be made for locking the bucket relative to its second axis of rotation when the rotary feature is not required and/or the gripping means may be so designed as to be stowable out of the way of conventional excavation or bucketing purposes.

A particularly preferred form of the present invention comprises a mounting bracket secured to the bucket for pivotally mounting the bucket on a support arm, a bucket container portion pivotally mounted upon said bracket, drive means for pivoting said container portion relative to said bracket, a gripping member mounted for movement between a rearward, non-gripping position in which said gripping member is located at least substantially within the container portion and a forward, gripping position in which gripping may be effected between said gripping member and an earth-engaging portion of said container portion, and means to move said gripping member between said respective positions, the axis of pivotal movement of said container portion relative to said bracket being substantially at right angles to the axis of pivotal movement of said bucket relative to said support arm.

While excavators and similar pieces of mobile construction plant come in various forms, one popular such unit is a combined excavator/loader. A unit of this sort has a bucket at each end. These two buckets differ somewhat in shape in order to perform different specialised functions but they have many similarities and each is able to operate as a bucket. Thus a first bucket, often mounted at the rear of the unit, is usually relatively narrower and is particularly suited for digging into ground (usually towards the machine), as well as for lifting or loading the material thus dug. This may be a so-called "back hoe". A second bucket, often mounted at the front of the unit, is usually much wider than the first and is particularly suited for loading material from the surface into a vehicle. This is the "loader" bucket. Also available are mobile loaders, having a bucket of this latter type only. The excavator bucket of the present invention may be of either of these types.

Similar considerations arise when the invention is applied to a bucket of either of the above types, although the details may be modified, in particular to take account of the differing bucket dimensions and the different forms of mounting conventionally used. Thus, for example, while a gripping member in both cases may advantageously be mounted for movement between a rearward, non-gripping position in which it is located at least substantially within the bucket and a forward, gripping position, the gripping member itself may differ depending upon the type of bucket to which it is fitted, and the manner of cooperation with the bucket may also differ. In the case of the narrower bucket, the gripping member may generally resemble an inverted bucket and may be nearly as wide as the excavator bucket itself. When fitted to a wider bucket of the loader type, the gripping member may be much narrower than the bucket itself and may resemble a claw in general appearance. In the case of a loader bucket in particular, the object may be held between the gripping member and the side-ends of the bucket; those side-ends may be adapted to assist the gripping action, for example by the provision of cut-outs to receive a telegraph pole.

The invention will now be further described with reference to the accompanying drawings, in which.

Figure 1:
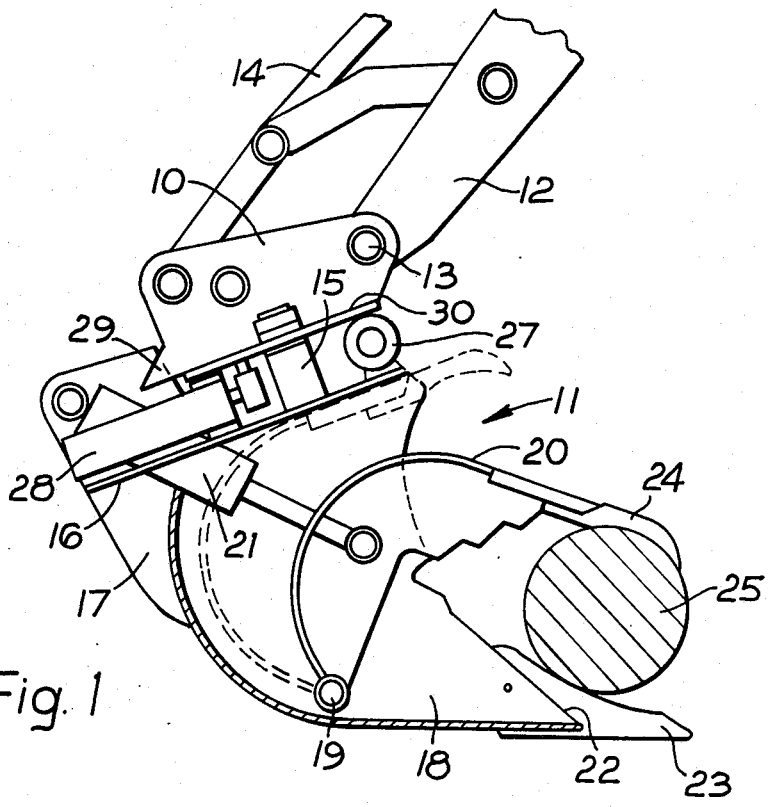
FIG. 1 is an elevational view, partly in section, of one form of excavator bucket (of the back-hoe type) according to the present invention.

Referring firstly to FIG. 1, a mounting bracket 10 for an excavator bucket assembly designated generally by the number 11 is carried at the outer end of the dipper arm 12 of a conventional excavator unit. The assembly is able to pivot in the usual way about a horizontal axis (the first axis of pivotal movement) defined by a pivot 13, the pivoting action being effected by a control arm 14.

Pivotally secured at 15 to the mounting bracket 10 is a backing plate 16 and associated bracket 17 by means of which the excavator bucket proper is supported. The bucket comprises two main parts, namely a container part 18 and, pivotally mounted at 19 within the container part 18, a gripping member 20 which is also generally bucket-shaped. The pivoting of the member 20 is effected by a piston 21. The withdrawn position of the gripping member 20 is shown in broken line in FIG. 1. As will readily be understood, activation of the piston 21 swings the gripping member 20 into a position such as is shown in full line in FIG. 1, where, as illustrated, an object may be gripped between the member 20 and the earth-engaging part 22 of the container part of the bucket. Typically, the part 22 carries teeth 23; teeth 24, which may be specifically shaped to grip, say, telegraph poles, are provided on the gripping member 20. In the drawings, the bucket is shown gripping a telegraph pole 25.

Figure 2:
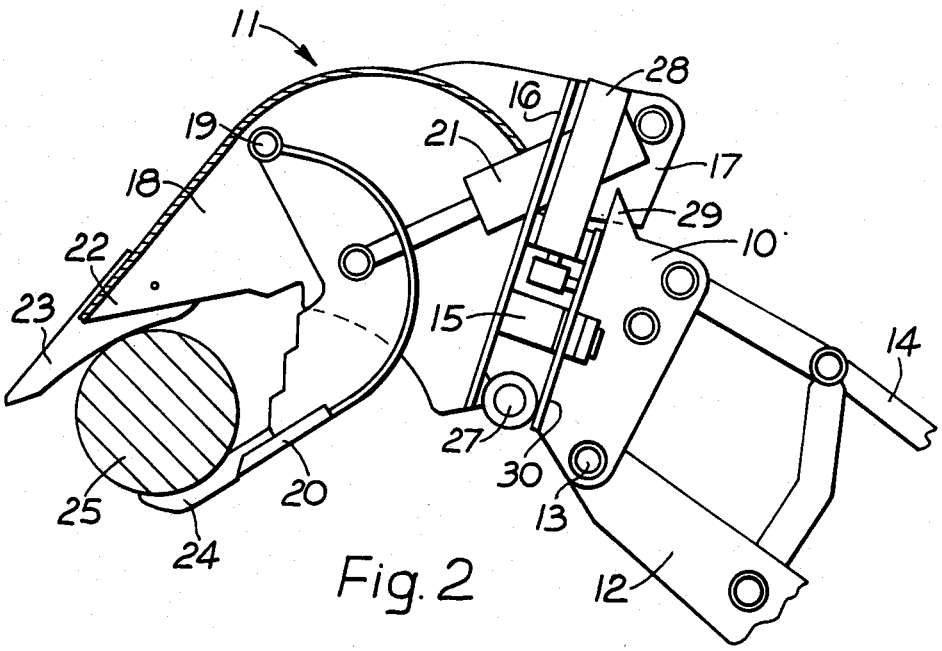
FIG. 2 is a view corresponding to FIG. 1 with the bucket in a second position.

In FIGS. 1 and 2 of the drawings, the excavator bucket assembly is shown in a typical working orientation, in which the bucket may function conventionally, with the gripping member 20 in use or stowed against the interior of the bucket as desired. In this position a tubular member 26 on the mounting bracket 10 is aligned with similar members 27 on the backing plate 16 and, for normal excavator operation, a locking rod may be inserted into the aligned bores of these three members to prevent rotation of the assembly about the pivot 15.

Figure 3:
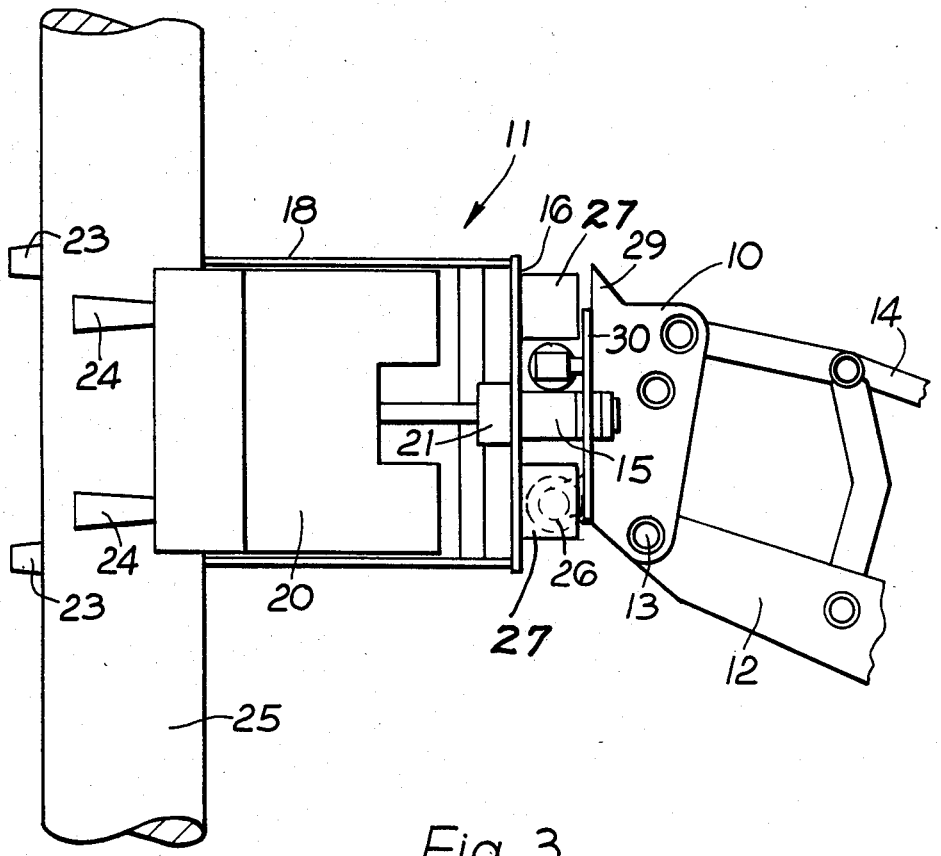
FIG. 3 is a view corresponding to FIGS. 1 and 2 with the bucket in a third position.

When the locking rod is not in place, activation of a double-acting piston 28 mounted on the bucket assembly swivels the assembly about the pivot 15 (the second axis of pivotal movement) to an extent determined by the length of stroke of the piston. In the illustrated embodiment, the maximum angle of pivoting is 109°. As shown in FIG. 3, pivoting of the bucket assembly about the pivot 15 swings the load (the telegraph pole 25) through the desired angle until the pole is substantially vertical. The pole 25 may now be held in this position until its base has been secured in the ground, whereupon activation of the piston 21 withdraws the gripping member 20 and releases the pole 25.

The bucket assembly may now be swivelled back (by activation of the piston 28) into its original position, in which position the bracket 17 abuts a stop 29 on the mounting bracket 10 and the tubular members 26 and 27 are aligned. If it is now desired that the bucket return to its simple excavating function, the locking rod may be inserted as described above.

As an alternative to the use of the locking rod and the tubular members 27, 26, 27 as a means of locking the bucket against rotation when it is to be used simply for excavating, hydraulic locking means may be provided. In one preferred alternative form of the bucket, the discshaped cross-member 30 of the mounting bracket 10 has limited freedom of axial movement on the pivot 15 and can therefore be clamped by means of a hydroclamp (not shown) against the support pedestals projecting from the adjacent face of the backing plate 16. An advantage of this form of locking means is that the load of the bucket in normal use is transferred from the pivot pin to the support pedestals.

Figure 4:
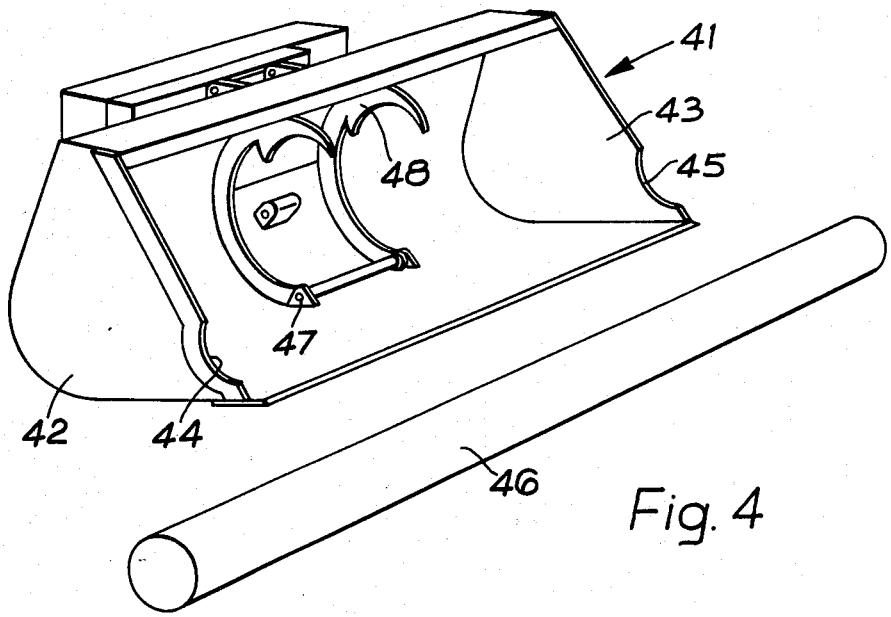
FIG. 4 is a perspective view of another form of excavator bucket (of the loader type) according to the present invention, with the gripping member in the withdrawn position.
Figure 5:
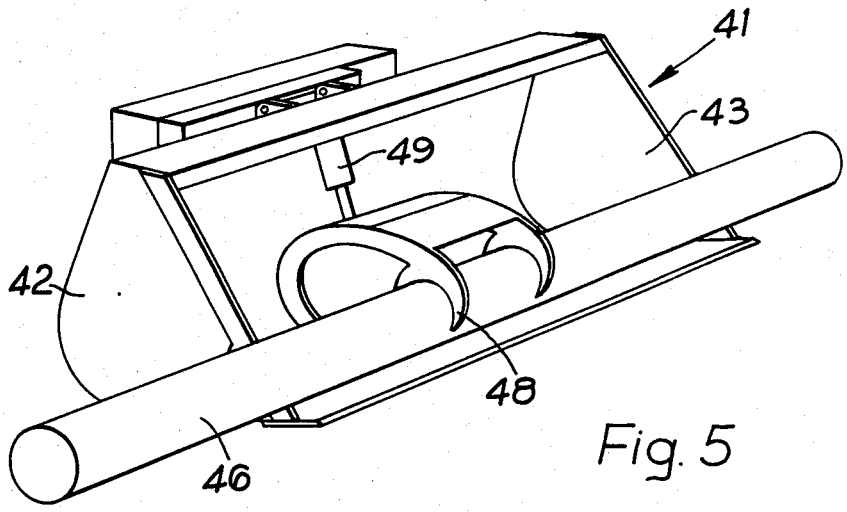
FIG. 5 is a view corresponding to FIG. 4 but with the gripper member in the gripping position.

Referring now to FIGS. 4 and 5, the illustrated loader-type excavator bucket 41 has side-ends 42, 43, shaped adjacent to their lower front edges with part-circular cut-outs 44, 45 of suitable dimensions to receive a telegraph pole 46. Mounted within the bucket towards the rear thereof, for pivotting about an axis 47, is a claw-shaped gripping member 48. By means of a double-acting piston 49, the gripping member 48 may be swung forward about the axis 47 until the member is able to cooperate with the cut-outs 44, 45 to pick up and grip securely the telegraph pole 46.

Figure 6:
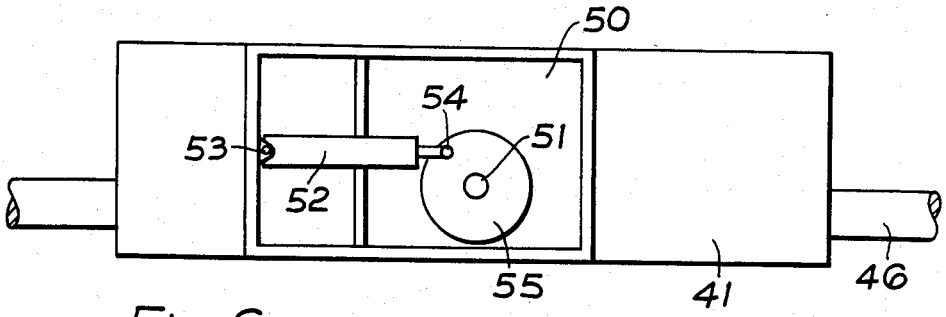
FIG. 6 is an elevation from the rear of the bucket of FIGS. 4 and 5 in horizontal position.
Figure 7:
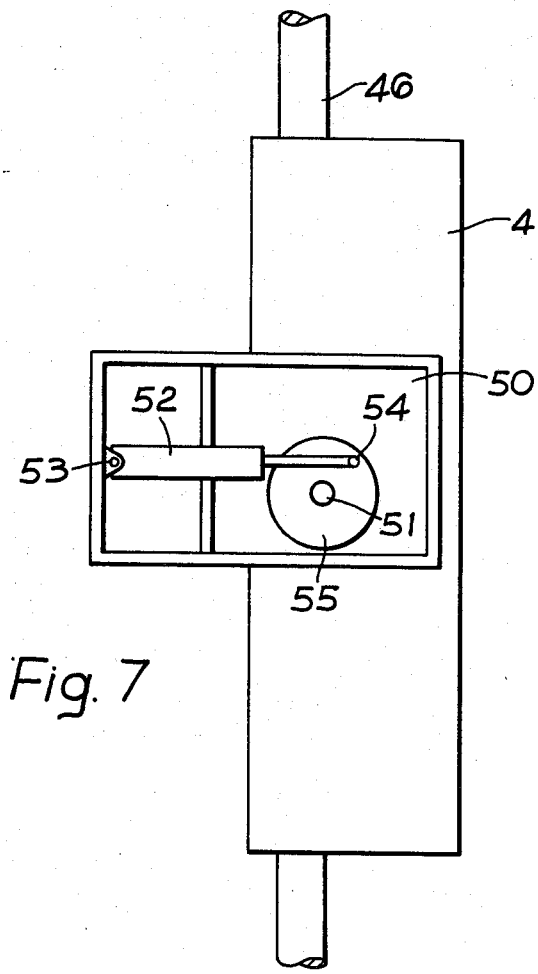
FIG. 7 is a view corresponding to FIG. 6 but with the bucket rotated into a vertical position.

As shown in FIGS. 6 and 7, the bucket 41 is in turn mounted on a support plate 50 for pivotal movement through an angle of at least ninety degrees about a pivot 51. Rotation of the bucket 41 is effected by means of a double-acting piston 52, extending between a piston mounting bracket 53 on the plate 50 and an eccentrically placed pin 54 on a turntable 55. Thus, when a load such as a telegraph pole has been picked up by the bucket in the manner shown in FIG. 5, it can be turned into a vertical orientation as illustrated in FIG. 7.

The excavator bucket shown in FIGS. 4 to 7, like the bucket of FIGS. 1 to 3, may be used conventionally (as a loader) when the special features which characterise the invention are not in use. In particular, the facility for rotation into a vertical position may not be required in normal use of the bucket and the bucket may then be locked mechanically or hydraulically in the horizontal orientation. Similarly, the gripping member may be stowed in its rearward, non-gripping position for conventional use of the bucket.

Finally, when the bucket according to the present invention is being used to its full effect for gripping and rotating a desired object, hydraulic or mechanical locking means may be provided to ensure that the gripping member continues to grip while the bucket is being rotated and/or to ensure that the bucket is not involuntarily rotated while an object is being gripped.

I claim:

1. An excavator apparatus for mobile construction equipment comprising:

(a) a mounting bracket adapted for pivotal attachment to a support arm for pivoting about a generally horizontal axis;

(b) a bucket container portion pivotally mounted upon said mounting bracket for pivoting relative thereto about an axis generally at right angles to said generally horizontal axis;

(c) a first hydraulic ram, operating between said bucket container portion and said mounting bracket for pivoting said container portion through an angle not exceeding a half-circle;

(d) a gripping member mounted upon a pivot within said bucket container portion for pivotal movement between a rearward position in which it is located at least substantially within said bucket container portion and a forward position in which an object may be gripped between said gripping member and an earth-engaging part of said container portion; and (e) a second hydraulic ram for moving said gripping member between said rearward and forward positions.

2. An excavator apparatus according to claim 1, having locking means to secure the bucket container portion against pivoting relative to the mounting bracket.

3. An excavator apparatus for mobile construction equipment comprising:

(a) a mounting bracket adapted for pivotal attachment to a support arm for pivoting about a generally horizontal axis (b) a bucket container portion pivotally mounted upon said mounting bracket for pivoting relative thereto about an axis generally at right angles to said generally horizontal axis;

(c) a first hydraulic ram, operating between said bucket container portion and said mounting bracket for pivoting said container portion through an angle not exceeding a half-circle;

(d) a gripping member mounted upon a pivot, which pivot is located within said bucket container portion at a point in the lower half of said bucket container portion and in a generally rearward part thereof;

(e) said gripping member being mounted to pivot about said pivot between a rearward position in which said gripping member is located at least substantially within said bucket container portion and a forward position in which an object may be gripped between said gripping member and an earthengaging forward edge of said container portion; and (f) a second hydraulic ram for moving said gripping member between said rearward and forward positions.

* * * * *